US006266637B1

(12) United States Patent
Donovan et al.

(10) Patent No.: US 6,266,637 B1
(45) Date of Patent: Jul. 24, 2001

(54) PHRASE SPLICING AND VARIABLE SUBSTITUTION USING A TRAINABLE SPEECH SYNTHESIZER

(75) Inventors: Robert E. Donovan, Mt. Kisco; Martin Franz, Yorktown Heights; Salim E. Roukos, Scarsdale, all of NY (US); Jeffrey Sorensen, Seymour, CT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/152,178

(22) Filed: Sep. 11, 1998

(51) Int. Cl.[7] ..... G10L 13/00
(52) U.S. Cl. ..... 704/258
(58) Field of Search ..... 704/258, 260, 704/265

(56) References Cited

U.S. PATENT DOCUMENTS

| | | | | |
|---|---|---|---|---|
| 4,692,941 | * | 9/1987 | Jacks et al. | 704/260 |
| 4,882,759 | * | 11/1989 | Bahl et al. | 704/243 |
| 5,202,952 | * | 4/1993 | Gillick et al. | 704/200 |
| 5,333,313 | * | 7/1994 | Heising | 707/1 |
| 5,384,893 | * | 1/1995 | Hutchins | 704/267 |
| 5,502,791 | * | 3/1996 | Nishimura et al. | 704/256 |
| 5,513,298 | * | 4/1996 | Stanford et al. | 704/243 |
| 5,526,463 | * | 6/1996 | Gillick et al. | 704/251 |
| 5,706,397 | * | 1/1998 | Chow | 704/243 |
| 5,839,105 | * | 11/1998 | Ostendorf et al. | 704/256 |
| 5,884,261 | * | 3/1999 | DeSouza et al. | 704/255 |
| 5,937,385 | * | 8/1999 | Zarozny et al. | 704/257 |
| 5,983,180 | * | 11/1999 | Robinson | 704/254 |
| 6,032,111 | * | 2/2000 | Mohri | 704/9 |
| 6,038,533 | * | 3/2000 | Buchsbaum et al. | 704/260 |

OTHER PUBLICATIONS

E–Speech web page; http://www.espeech.com/NaturalSynthesis.htm.
Bahl et al., (1993) Context Dependent Vector Quantization for Continuous Speech Recognition; Proc. ICASSP 93, Minneapolis, vol. 2, pp. 632–635.
Donovan, R.E. (1996); Trainable Speech Synthesis, PhD. Thesis, Cambridge University Engineering Department.
Donovan, et al., (1998), The IBM Trainable Speech Synthesis System, Proc. ICSLP 98, Sydney.
Moulines et al., (1990), Pitch–Synchronous Waveform Processing Techniques for Text–to–Speech Synthesis Using Diphones, Speech Communication, 9, pp. 453–467.
Jon Rong–Wei Yi; Natural–Sounding Speech Synthesis Using Varibable–Length Units; Massachusetts Institute of Technology; pp. 1 –121; 1998.

* cited by examiner

*Primary Examiner*—Krista Zele
*Assistant Examiner*—Michael N. Opsasnick
(74) *Attorney, Agent, or Firm*—F. Chau & Associates, LLP

(57) ABSTRACT

In accordance with the present invention, a method for providing generation of speech includes the steps of providing input to be acoustically produced, comparing the input to training data or application specific splice files to identify one of words and word sequences corresponding to the input for constructing a phone sequence, using a search algorithm to identify a segment sequence to construct output speech according to the phone sequence and concatenating segments and modifying characteristics of the segments to be substantially equal to requested characteristics. Application specific data is advantageously used to make pertinent information available to synthesize both the phone sequence and the output speech. Also, described is a system for performing operations in accordance with the disclosure.

27 Claims, 5 Drawing Sheets

| | |
|---|---|
| You have ten dollars only | Y UW HH AE V X T EH N D AO L ER Z OW N L IY |
| You have ten dollars | Y UW HH AE V X T EH N D AO L ER Z |
| You have ten | Y UW HH AE V X T EH N |
| You have | Y UW HH AE V |
| You | Y UW |
| have ten dollars only | HH AE V X T EH N D AO L ER Z OW N L IY |
| have ten dollars | HH AE V X T EH N D AO L ER Z |
| have ten | HH AE V X T EH N |
| have | HH AE V |
| ten dollars only | T EH N D AO L ER Z OW N L IY |
| ten dollars | T EH N D AO L ER Z |
| ten | T EH N |
| dollars only | D AO L ER Z OW N L IY |
| dollars | D AO L ER Z |
| only | OW N L IY |

FIG. 2

PHRASE SPLICING AND VARIABLE SUBSTITUTION USING A TRAINABLE SPEECH SYNTHESIZER

BACKGROUND OF THE INVENTION

1. Field of the Invention

The present invention relates to speech splicing and, more particularly, to a system and method for phrase splicing and variable substitution of speech using a synthesizing device.

2. Description of the Related Art

Speech recognition systems are used in many areas today to transcribe speech into text. The success of this technology in simplifying man-machine interaction is stimulating the use of this technology into a plurality of useful applications, such as transcribing dictation, voicemail, home banking, directory assistance, etc. In particularly useful applications, it is often advantageous to provide synthetic speech generation as well.

Synthetic speech generation is typically performed by utterance playback or full text-to-speech (TTS) synthesis. Recorded utterances provide high speech quality and are typically best suited for applications where the number of sentences to be produced is very small and never changes. However, there are limits to the number of utterances which can be recorded. Expanding the range of recorded utterance systems by playing phrase and word recordings to construct sentences is possible, but does not produce fluent speech and can suffer from serious prosodic problems.

Text-to-speech systems may be used to generate arbitrary speech. They are desirable for some applications, for example where the text to be spoken cannot be known in advance, or where there is simply too much text to prerecord everything. However, speech generated by TTS systems tends to be both less intelligible and less natural than human speech.

Therefore, a need exists for a speech synthesis generation system which provides all the advantages of recorded utterances and text-to-speech synthesis. A further need exists for a system and method capable of blending pre-recorded speech with synthetic speech.

SUMMARY OF THE INVENTION

In accordance with the present invention, a method for providing generation of speech includes the steps of providing input to be acoustically produced, comparing the input to training data to identify one of words and word sequences corresponding to the input for constructing a phone sequence, comparing the input to a pronunciation dictionary when the input is not found in the training data, identifying a segment sequence using a first search algorithm to construct output speech according to the phone sequence and concatenating segments of the segment sequence and modifying characteristics of the segments to be substantially equal to requested characteristics.

In other methods, the characteristics may include at least one of duration, energy and pitch. The step of comparing may include the step of searching the training data using a second search algorithm. The second search algorithm may include a greedy algorithm. The first search algorithm preferably includes a dynamic programming algorithm. The step of outputting synthetic speech is also provided. The method may further include the step of using the first search algorithm, performing a search over the segments in decision tree leaves.

Another method for providing generation of speech includes the steps of providing input to be acoustically produced, comparing the input to application specific splice files to identify one of words and word sequences corresponding to the input for constructing a phone sequence, augmenting a generic segment inventory by adding segments corresponding to the identified words and word sequences, identifying a segment sequence, using a first search algorithm and the augmented generic segment inventory to construct output speech according to the phone sequence and concatenating the segments of the segment sequence and modifying characteristics of the segments of the segment sequence to be substantially equal to requested characteristics.

In particularly useful methods, the characteristics may include at least one of duration, energy and pitch. The step of comparing may include the step of searching the application specific inventory using a second search algorithm and a splice file dictionary. The second search algorithm may include a greedy algorithm. The first search algorithm preferably includes a dynamic programming algorithm. The step of outputting synthetic speech is also provided.

The step of comparing may include the step of comparing the input to a pronunciation dictionary when the input is not found in the splice files. The method may further include the step of by using the first search algorithm, performing a search over the segments in decision tree leaves. The step of identifying may include the steps of bypassing costing of the characteristics of the segments from a splicing inventory against the requested characteristics. The step of identifying may include the step of applying pitch discontinuity costing across the segment sequence. The method may further include the step of selecting segments from a splicing inventory to provide the requested characteristics. The requested characteristics may include pitch and the method may further include the step of selecting segments from the generic segment inventory to provide the requested pitch characteristics. The method may further include the step of applying pitch discontinuity smoothing to the requested pitch characteristics provided by the selected segments from the generic segment inventory.

A system for generating synthetic speech, in accordance with the invention includes means for providing input to be acoustically produced and means for comparing the input to application specific splice files to identify one of words and word sequences corresponding to the input for constructing a phone sequence. Means for augmenting a generic segment inventory by adding segments corresponding to sentences including the identified words and word sequences and a synthesizer for utilizing a first search algorithm and the augmented generic inventory to identify a segment sequence to construct output speech according to the phone sequence are also included. Means for concatenating segments of the segment sequence and modifying characteristics of the segments of the segment sequence to be substantially equal to requested characteristics, is further included.

In alternative embodiments, the generic segment inventory includes pre-recorded speaker data to train a set of decision-tree state-clustered hidden Markov models. The second search algorithm may include a greedy algorithm and a splice file dictionary. The means for comparing may compare the input to a pronunciation dictionary when the input is not found in the splice files. The first search algorithm may perform a search over the segments in decision tree leaves. The means for providing input may include an application specific host system. The application specific host system may include an information delivery system. The first search algorithm may include a dynamic programming algorithm. The comparing means may include a searching algorithm which may include a greedy algorithm and a splice file dictionary. The means for providing input may include an application specific host system which may include an information delivery system.

These and other objects, features and advantages of the present invention will become apparent from the following detailed description of illustrative embodiments thereof, which is to be read in connection with the accompanying drawings.

BRIEF DESCRIPTION OF DRAWINGS

The invention will be described in detail in the following description of preferred embodiments with reference to the following figures wherein:

FIG. 2 is a table showing splice file dictionary entries for the sentence "You have ten dollars only." in accordance with the present invention;

DETAILED DESCRIPTION OF PREFERRED EMBODIMENTS

The present invention relates to speech splicing and, more particularly, to a system and method for phrase splicing and variable substitution of speech using a synthesizing device. Phrase splicing and variable substitution in accordance with the present invention provide an improved means for generating sentences. These processes enable the blending of pre-recorded phrases with each other and with synthetic speech. The present invention yields higher quality speech than a pure TTS system to be generated in different application domains.

In the system in accordance with the present invention, unrecorded words or phrases may be synthesized and blended with pre-recorded phrases or words. A pure variable substitution system may include a set of carrier phrases including variables. A simple example is "The telephone number you require is XXXX", where "The telephone number you require is" is the carrier phrase and XXXX is the variable. Prior art systems provided the recording of digits, in all possible contexts, to be inserted as the variable. However, for more general variables, such as names, this may not be possible, and a variable substitution system in accordance with the present invention is needed.

Figure 1:
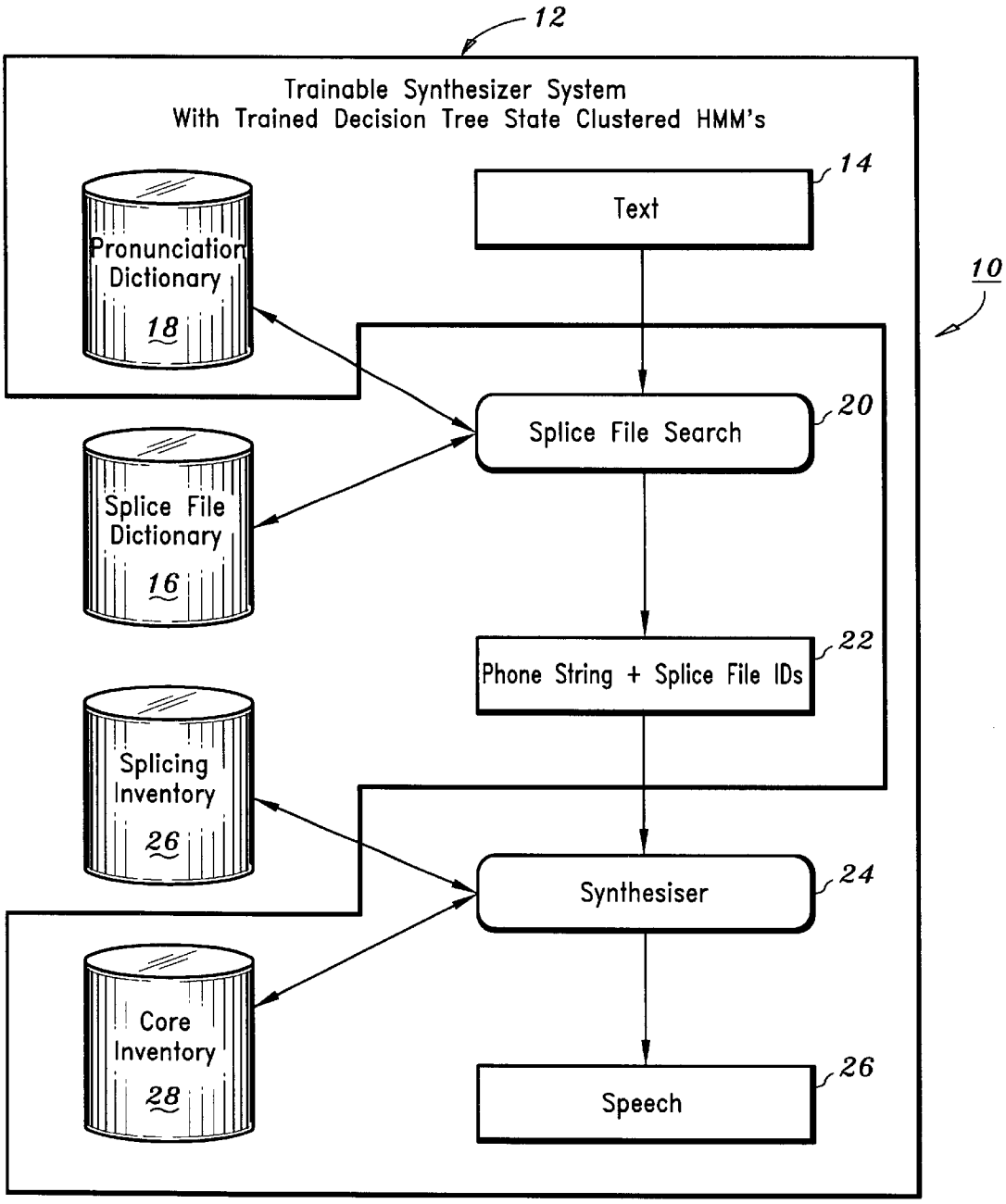
FIG. 1 is a block/flow diagram of a phrase splicing and variable substitution of speech generating system/method in accordance with the present invention.
Figure 3:
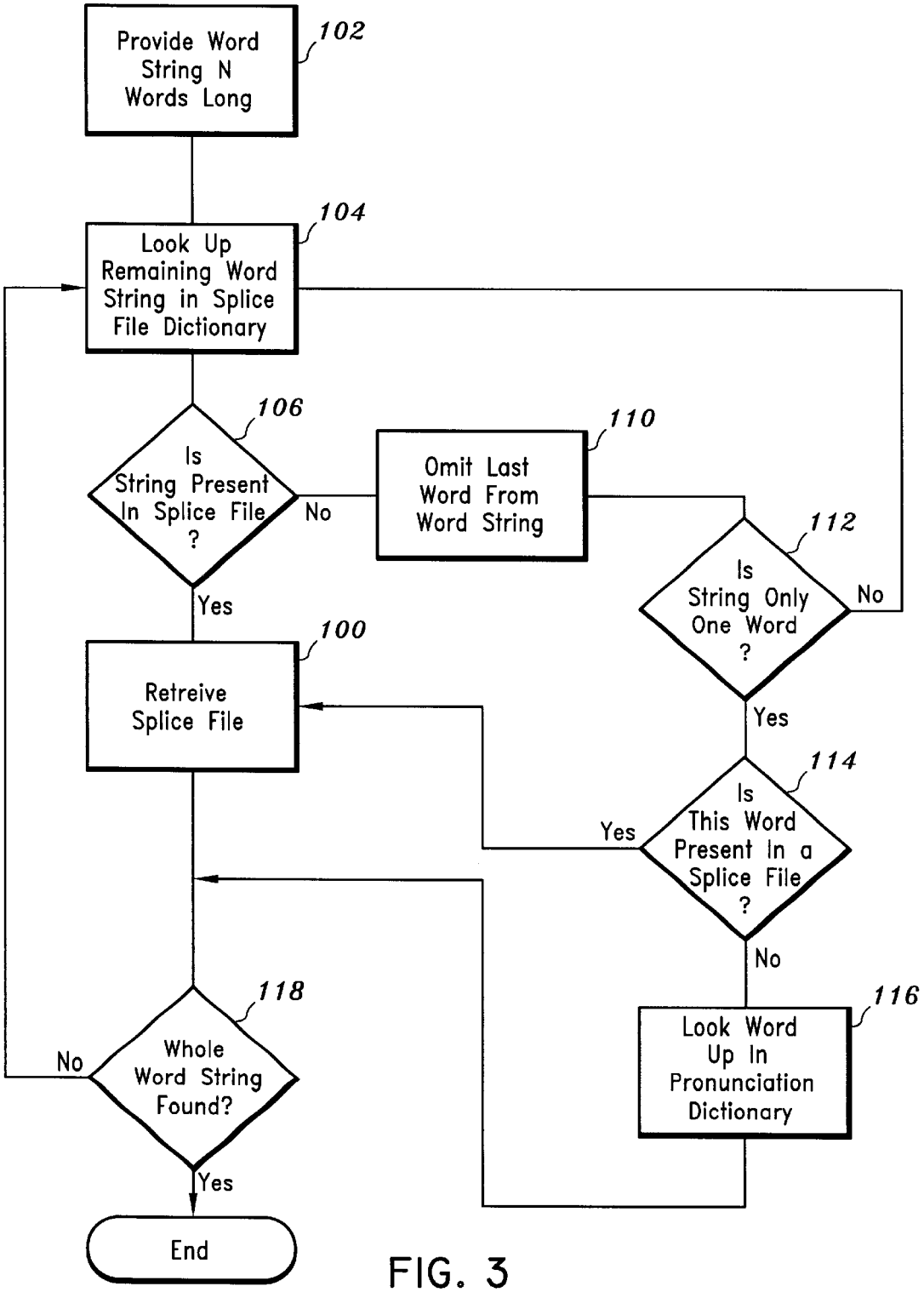
FIG. 3 is a block/flow diagram of an illustrative search algorithm used in accordance with the present invention.
Figure 4:
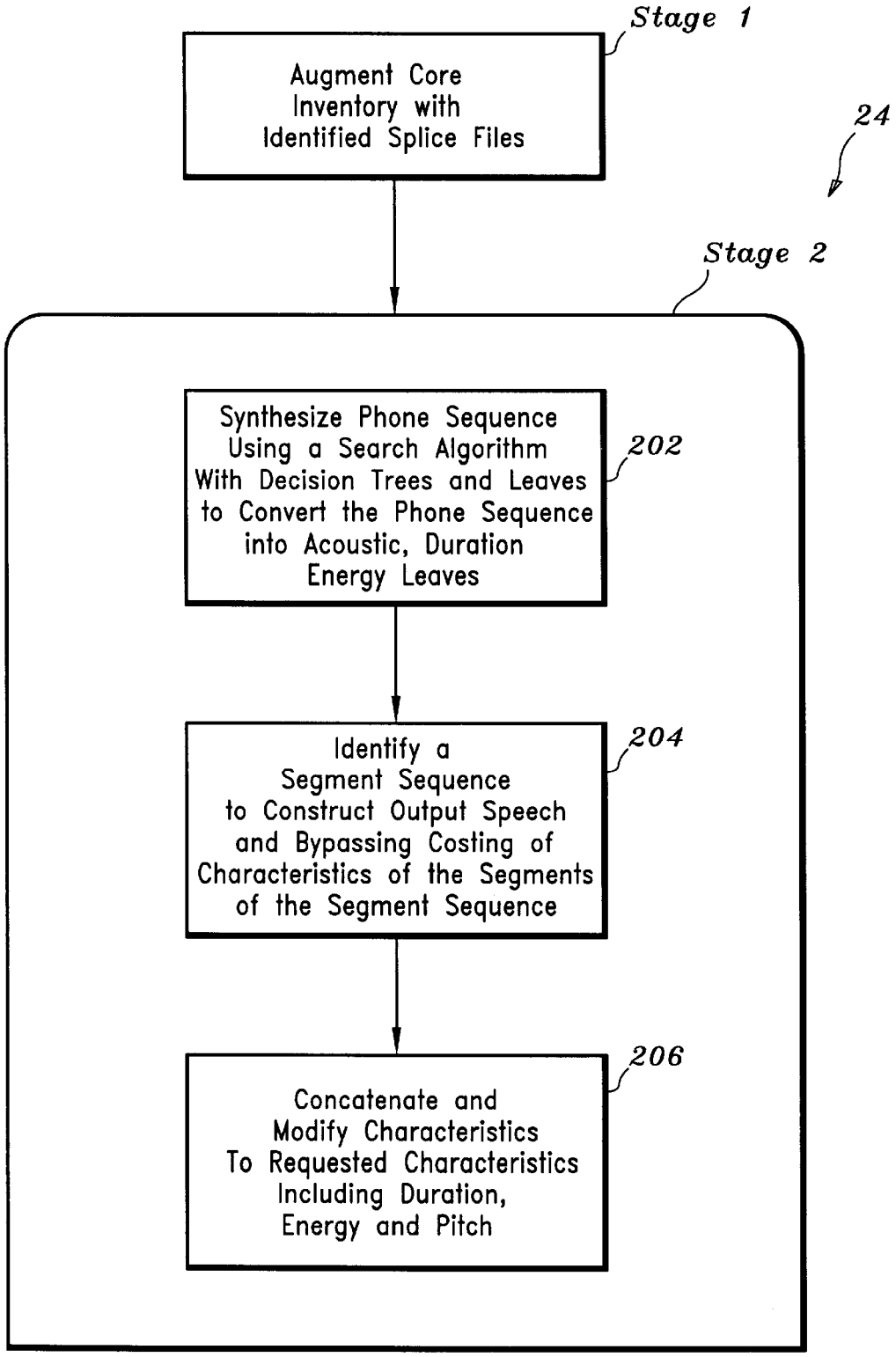
FIG. 4 is a block/flow diagram for synthesis of speech for the phrase splicing and variable substitution system of FIG. 1 in accordance with the present invention.

It should be understood that the elements shown in FIGS. 1, 3 and 4 may be implemented in various forms of hardware, software or combinations thereof. Preferably, these elements are implemented in software on one or more appropriately programmed general purpose digital computers having a processor and memory and input/output interfaces. Referring now to the drawings in which like numerals represent the same or similar elements and initially to FIG. 1, a flow/block diagram is shown of a phrase splicing and variable substitution system 10 in accordance with the present invention. System 10 may be included as a part of a host or core system and includes a trainable synthesizer system 12. Synthesizer system 12 may include a set of speaker-dependent decision tree state-clustered hidden Markov models (HMMs) that are used to automatically generate a leaf level segmentation of a large single-speaker continuous-read-speech database. During synthesis by synthesizer 12, the phone sequence to be synthesized is converted to an acoustic leaf sequence by descending the HMM decision trees. Duration, energy and pitch values are predicted using separate trainable models. To determine the segment sequence to concatenate, a dynamic programming (d.p.) search is performed over all waveform segments aligned to each leaf in training. The d.p. attempts to ensure that the selected segments join each other spectrally, and have durations, energies and pitches such that the amount of degradation introduced by the subsequent use of signal processing algorithms such as, a time domain pitch synchronization overlap add (TD-PSOLA) algorithm, are minimized. Algorithms embedded within the d.p. can alter the acoustic leaf sequence, duration and energy values to ensure high quality synthetic speech. The selected segments are concatenated and modified to have needed prosodic values using, for example the TD-PSOLA algorithm. The d.p. results in the system effectively selecting variable length units, based upon its leaf level framework.

To perform phrase splicing or variable substitution, system 12 is trained on a chosen speaker. This includes a recording session which preferably involves about 45 minutes to about 60 minutes of speech from the chosen speaker. This recording is then used to train a set of decision tree state clustered hidden Markov models (HMMs) as described above. The HMMs are used to segment a training database into decision tree leaves. Synthesis information, such as segment, energy, pitch, endpoint spectral vectors and/or locations of moments of glottal closure, is determined for each of the training database segments. Separate sets of trees are built from duration and energy data to enable prediction of duration and energy during synthesis. Illustrative examples for training system 12 are described in Donovan, R. E. et al., "The IBM Trainable Speech Synthesis System", Proc. ICSLP '98, Sydney, 1998.

Phrases to be spliced or joined together by splicing/variable substitution system 10 are preferably recorded in the same voice as the chosen speaker for system 12. It is preferred that the splicing process does not alter the prosody of the phrases to be spliced, and it is therefore preferred that the splice phrases are recorded with the same or similar prosodic contexts, as will be used in synthesis. Splicing/variable substitution files are processed using HMMs in the same way as the speech used to construct system 12. This processing yields a set of splice files associated with each additional splice phrase. One of the splice files is called a lex file. The lex file includes information about the words and phones in the splice phrase and their alignment to a speech waveform. Other splice files include synthesis information about the phrase identical to that described above for system 12. One splice file includes the speech waveform.

A splice file dictionary 16 is constructed from the lex files to include every word sequence of every length present in the splice files, together with the phone sequence aligned against those words. Silences occurring between the words of each entry are retained in a corresponding phone sequence definition. Referring now to FIG. 2, splice file dictionary entries are illustratively shown for the sentence "You have ten dollars only". /X/ is the silence phone.

With continued reference to FIG. 1, text to be produced is input by a host system at block 14 to be synthesized by system 10. The host system may include an integrated or a separate dialog system for example an information delivery system or interactive speech system. The text is converted automatically into a phone sequence. This may be performed using a search algorithm in block 20, splice file dictionary 16 and a pronunciation dictionary 18. Pronunciation dictionary 18 is used to supply pronunciations of variables and/or unknown words.

In block 22, a phone string (or sequence) is created from the phone sequences found in the splice files of splice dictionary 16 where possible and pronunciation dictionary 18 where not. This is advantageous for at least the following reasons:

1) If the phone sequence adheres to splice file phone sequences (including silences) over large regions then large fragments of splice file speech can be used in synthesis, resulting in fewer joins and hence higher quality synthetic speech.

2) Pronunciation ambiguities are resolved if appropriate words are available in the splice files in the appropriate context. For example, the word "the" can be /DH AX/ or /DH IY/. Pronunciation ambiguities may be resolved if splice files exist which determine which must be used in a particular word context.

The block 20 search may be performed using a left to right greedy algorithm. This algorithm is described in detail in FIG. 3. An N word string is provided to generate a phone sequence in block 102. Initially, the N word string to be synthesized is looked up in splice file dictionary 16 in block 104. In block 106, if the N word string is present, then the corresponding phone string is retrieved in block 108. If not found, the last word is omitted in block 110 to provide an N-1 word string. If, in block 112, the string includes only one word the program path is directed to block 114. If more than one word exists in the string, then the word string including the first N-1 words is looked up in block 104. This continues until either some word string is found and retrieved in block 108 or only the first word remains and the first word is not present in splice file dictionary 16 as determined in block 114. If the first word is not present in splice file dictionary 16 then the word is looked up in pronunciation dictionary 18 in block 116. In block 118, having established the phone sequence for the first word (or word string), the process continues for the remaining words in the sentence until a complete phone sequence is established.

Referring again to FIG. 1, in block 22, the phone sequence and the identities of all splice files used to construct the complete phone sequence are noted for use in synthesis as performed in block 24 and described herein.

System 12 is used to perform text-to-speech synthesis (TTS) and is described in the article by Donovan, R. E. et al., "The IBM Trainable Speech Synthesis System", previously incorporated herein by reference and summarized here as follows.

An IBM trainable speech system, described in Donovan, et al., is trained on 45 minutes of speech and clustered to give approximately 2000 acoustic leaves. The variable rate Mel frequency cepstral coding is replaced with a pitch synchronous coding using 25 ms frames through regions of voiced speech, with 6 ms frames at a uniform 3 ms or 6 ms frame rate through regions of unvoiced speech. Plosives are represented by 2-state models, but the burst is not optional. Lexical stress clustering is not currently used, and certain segmentation cleanups are not implemented. The tree building process uses the algorithms, which will be described here to aid understanding.

A binary decision tree is constructed for each feneme (A feneme is a term used to describe an individual HMM model position, e.g., the model for /AA/ comprises three fenemes AA_1, $AA_{13}$ 2, and AA_3) as follows. All the data aligned to a feneme is used to construct a single Gaussian in the root node of the tree. A list of questions about the phonetic context of the data is used to suggest splits of the data into two child nodes. The question which results in the maximum gain in the log-likelihood of the data fitting Gaussians constructed in the child nodes compared to the Gaussian in the parent node is selected to split the parent node. This process continues at each node of the tree until one of two stopping criteria is met. These are when a minimum gain in log-likelihood cannot be obtained or when a minimum number of segments in both child nodes cannot be obtained, where a segment is all contiguous frames in the training database with the same feneme label. The second stopping criteria includes a minimum number of segments which is required for subsequent segment selection algorithms. Also, node merging is not permitted in order to maintain the one parent structure necessary for the Backing Off algorithm described below.

The acoustic (HMM) decision trees are built asking questions about only immediate phonetic context. While asking questions about more distant contexts may give slightly more accurate acoustic models it can result in being in a leaf in synthesis from which no segments are available which concatenate smoothly with neighboring segments, for reasons similar to those described below. Separate sets of decision trees are built to cluster duration and energy data. Since the above concern does not apply to these trees they are currently built using 5 phones of phonetic context information in each direction, though to date the effectiveness of this increased context, or indeed the precise values of the stopping criteria have not been investigated.

RUNTIME SYNTHESIS (for IBM trainable speech system, described in Donovan, et al.)

Parameter Prediction.

During synthesis the words to be synthesized are converted to a phone sequence by dictionary lookup, with the selection between alternatives for words with multiple pronunciations being performed manually. The decision trees are used to convert the phone sequence into an acoustic, duration, and energy leaf for each feneme in the sequence. The median training values in the duration and energy leaves are used as the predicted duration and energy values for each feneme. The acoustic leaf sequence, duration and energy values just described are termed the requested parameters from hereon. Pitch tracks are also predicted using a separate trainable model not described in this paper.

Dynamic Programming.

The next stage of synthesis is to perform a dynamic programming (d.p.) search over all the waveform segments aligned to each acoustic leaf in training, to determine the segment sequence to use in synthesis. The d.p. algorithm, and related algorithms which can modify the requested acoustic leaf identities, energies and durations, are described below.

Energy Discontinuity Smoothing.

Once the segment sequence has been determined, energy discontinuity smoothing is applied. This is necessary because the decision tree energy prediction method predicts each feneme's energy independently, and does not ensure any degree of energy continuity between successive fenemes. Note that it is energy discontinuity smoothing (the discontinuity between two segments is defined as the difference between the energy (per sample) of the second segment minus the energy (per sample) of the segment in the training data following the first segment), not energy smoothing; changes in energy of several orders of magnitude do occur between successive fenemes in real human speech, and these changes must not be smoothed away.

TD-PSOLA.

Finally, the selected segment sequence is concatenated and modified to match the required duration, energy and pitch values using an implementation of a TD-PSOLA algorithm. The Hanning windows used are set to the smaller of twice the synthesis pitch period or twice the original pitch period.

DYNAMIC PROGRAMMING (for the IBM trainable speech system, described in Donovan, et al.)

The dynamic programming (d.p.) search attempts to select the optimal set of segments from those available in the acoustic decision tree leaves to synthesis the requested acoustic leaf sequence with the requested duration, energy and pitch values. The optimal set of segments is that which most accurately produces the required sentence after TD-PSOLA has been applied to modify the segments to have the requested characteristics. The cost function used in the d.p. algorithm, therefore reflects the ability of TD-PSOLA to perform modifications without introducing perceptual degradation. Two additional algorithms enable the d.p. to modify the requested parameters where necessary to ensure high quality synthetic speech.

THE COST FUNCTION (for the IBM trainable speech system, described in Donovan, et al.)

Continuity Cost.

The strongest cost in the d.p. cost function is the spectral continuity cost applied between successive segments. This cost is calculated for the boundary between two segments A and B by comparing a spectral vector calculated from the start of segment B to a spectral vector calculated from the start of the segment following segment A in the training database. The continuity cost between two segments which were adjacent in the training data is therefore zero. The vectors used are 24 dimensional Mel binned log FFT vectors. The cost is computed by comparing the loudest regions of the two vectors after scaling them to have the same energy; energy continuity is costed separately. This method has been found to work better than using a simple Euclidean distance between cepstral vectors.

The effect of the strong spectral continuity cost together with the feature that segments which were adjacent in the training database have a continuity cost of zero is to encourage the d.p. algorithm to select sequences of segments which were originally adjacent wherever possible. The result is that the system ends up effectively selecting and concatenating variable length units, based upon its leaf level framework.

Duration Cost.

The TD-PSOLA algorithm introduces essentially no artifacts when reducing durations, and therefore duration reduction is not costed. Duration increases using the TD-PSOLA algorithm however can cause serious artifacts in the synthetic speech due to the over repetition of voiced pitch pulses, or the introduction of artificial periodicity into regions of unvoiced speech. The duration stretching costs are therefore based on the expected number of repetitions of the Hanning windows used in the TD-PSOLA algorithm.

Pitch Cost.

There are two aspects to pitch modification degradation using TD-PSOLA. The first is related to the number of times individual pitch pulses are repeated in the synthetic speech, and this is costed by the duration costs just described. The other cost is due to the fact that pitch periods cannot really be considered as isolated events, as assumed by the TD-PSOLA algorithm; each pulse inevitably carries information about the pitch environment in which it was produced, which may be inappropriate for the synthesis environment. The degradation introduced into the synthetic speech is more severe the larger the attempted pitch modification factor, and so this aspect is costed using curves which apply increasing costs to larger modifications.

Energy Cost.

Energy modification using TD-PSOLA involves simply scaling the waveform. Scaling down is free under the cost function since it does not introduce serious artifacts. Scaling up, particularly scaling quiet sounds to have high energies, can introduce artifacts however, and it is therefore costed accordingly.

Cost Capping/Post Selection Modification (for the IBM trainable speech system, described in Donovan, et al.)

During synthesis, simply using the costs described above results in the selection of good segment sequences most of the time. However, for some segments in which one or more costs becomes very large the procedure breaks down. to illustrate the problem, imagine a feneme for which the predicted duration was 12 Hanning windows long, and yet every segment available was only 1–3 Hanning windows long. This would result in poor synthetic speech for two reasons. Firstly whichever segment is chosen the synthetic speech will contain a duration artifact. Secondly, given the cost curves being used, the duration costs will be so much cheaper for the 3-Hanning-window segment(s) than the 1 or 2 Hanning-window segment(s), that a 3-Hanning-window segment will probably be chosen almost irrespective of how well it scores on every other cost capping/post selection modification scheme was introduced.

Under the cost capping scheme, every cost except continuity is capped during the d.p. at the value which corresponds to the approximate limit of acceptable signal processing modification. After the segments have been selected, the post-selection modification stage involves changing (generally reducing) the requested characteristics to the values corresponding to the capping cost. In the above example, if the limit of acceptable duration modification was to repeat every Hanning window twice, then if a 2-Hanning-window segment were selected it would be costed for duration doubling, and ultimately produced for 4 Hanning windows in the synthetic speech. Thus the requested characteristics can be modified in the light of the segments available to ensure good quality synthetic speech. The mechanism is typically invoked only a few times per sentence.

Backing Off (for IBM trainable speech system, described in Donovan, et al.)

The decision tree used in the system enable the rapid identification of a sub-set of the segments available for synthesis with hopefully the mot appropriate phonetic contexts. However, in practice the decision trees do occasionally make mistakes, leading to the identification of inappropriate segments in some contexts. To understand why, consider the following example.

Imagine that the tree fragment shows in FIG. 1 exists, in which the question "R to the right?" was determined to give the biggest gain in log-likelihood. Now imagine that in synthesis the context ID-AA+!R/ is to be synthesized. The tree fragment in FIG. 1 will place this context in the /!D-AA+!R/ node, in which there is unfortunately no /D-AA/speech available. Now, if the /D/ has a much bigger influence on the /AA/ speech than the presence or absence of the following /R/ then this is a problem. It would be preferable to descend to the other node where /D-AA/ speech is available, which would be more appropriate despite it's /+R/ context. In short, it is possible to descend to leaves which do not contain the most appropriate speech for the context specified. The most audible result of this type of problem is formant discontinuities in the synthetic speech, since the speech available from the inappropriate leaf is unlikely to concatenate smoothly with its neighbors.

The solution to this problem adopted in the current system has been termed *Backing Off*. When backing off is enabled the continuity costs computed between all the segments in the current leaf and all the segments in the next leaf during the d.p. forward pass are compared to some threshold. If it is determined that there are no segments in the current leaf which concatenate smoothly (i.e. cost below the threshold) with any segments in the next leaf, then both leaves are backed off up their respective decision trees to their parent nodes. The continuity computations are then repeated using the set of segments at each parent node formed by pooling all the segments in all the leaves descended from that parent. This process is repeated until either some segment pair costs less than the threshold, or the root node in both trees is reached. By determining the leaf sequence implied by the selected segment sequence, and comparing this to the original leaf sequence, it has been determined that in most cases backing off does change the leaf sequence (it is possible that after the backing off process the selected segments still come from the original leaves). The process has been seen (in spectrograms) and heard, to remove formiant discontinuities from the synthetic speech, and is typically invoked only a few times per sentence.

If there are no segments with a concatenation cost lower that the threshold then there will be a continuity problem, which hopefully backing off will solve. However, it may be the case that even when there are one or more pairs of concatenable segments available these cannot be used because they do not join to the rest of the sequence. Ideally then, the system would operate with multiple passes of the entire dynamic programming process, backing off to optimize sequence continuity rather than pair continuity. However, this approach is probably too computationally intensive for a practical system.

Finally, note that the backing of mechanism could also be used to correct the leaf sequences used in decision tree based speech recognition systems. In the TTS system, system 12, the text to be synthesized is converted to a phone string by dictionary lookup, with the selection between alternatives for words with multiple pronunciations being made manually. The decision trees are used to convert the phone sequence into an acoustic, duration and energy leaf for each feneme in the sequence. A feneme is a term used to describe an individual HMM model position, for example, the model for /AA/ includes three fenemes AA1, AA2, AA3. Median training values in the duration and energy leaves are used as the predicted duration and energy values for each feneme. Pitch tracks are predicted using a separate trainable model.

The synthesis continues by performing a dynamic programming (d.p.) search over all the waveform segments aligned to each acoustic leaf in training, to determine the segment sequence to use in synthesis. An optimal set of segments is that which most accurately produces the required sentence after a signal processing algorithm, such as TD-PSOLA, has been applied to modify the segments to have the requested (predicted) duration, energy and pitch values. A cost function may be used in the d.p. algorithm to reflect the ability of the signal processing algorithm to perform modifications without introducing perceptual degradation. Algorithms embedded within the d.p. can modify requested acoustic leaf identities, energies and durations to ensure high quality synthetic speech. Once the segment sequence has been determined, energy discontinuity smoothing may be applied. The selected segment sequence is concatenated and modified to match the requested duration, energy and pitch values using the signal processing algorithm.

In accordance with the present invention synthesis is performed in block 24. It is to be understood that the present invention may also be used at the phone level rather than the feneme level. If the phone level system is used, HMMs may be bypassed and hand labeled data may be used instead. Referring to FIGS. 1 and 4, block 24 includes two stages as shown in FIG. 4. A first stage (labeled stage 1 in FIG. 4) of synthesis is to augment an inventory of segments for system 12 with segments included in splicing files identified in block 22 (FIG. 1). The splice file segments and their related synthesis information of a splicing or application specific inventory 26 are temporarily added to the same structures in memory used for the core inventory 28. The splice file segments are then available to the synthesis algorithm in exactly the same way as core inventory segments. The new segments of splicing inventory 26 are marked as splice file segments, however, so that they may be treated slightly differently by the synthesis algorithm. This is advantageous since in many instances the core inventory may be deficient of a segment closely matching those needed to synthesize the input.

A second stage of synthesis (labeled stage 2 in FIG. 4), in accordance with the present invention, proceeds the same as described above for the TTS system (system 12) to convert phones to speech in block 202, except for the following:

1) During the d.p. search in block 204, splice segments are not costed relative to the predicted duration, energy or pitch values, but pitch discontinuity costing is applied. Costing and costed refer to a comparison between segments or between segment's inherent characteristics (i.e., duration, energy, pitch), and the predicted (i.e. requested) characteristics according to a relative cost determined by a cost function. A segment sequence is identified in block 204 to construct output speech.

2) After segment selection, the requested duration and energy of each splice segment are set to the duration and energy of the segment selected. The requested pitch of every segment is set to the pitch of the segment selected Pitch discontinuity smoothing is also applied in block 206.

Pitch discontinuity costing and smoothing are advantageously applied during synthesis in accordance with the present invention. The concept of pitch discontinuity costing and smoothing is similar to the energy discontinuity costing and smoothing described in the article by Donovan, et al. referenced above. The pitch discontinuity between two segments is defined as the pitch on the current segment minus the pitch of the segment following the previous segment in the training database or splice file in which it occurred. There is therefore no discontinuity between segments which were adjacent in training or a splice file, and so these pitch variations are neither costed nor smoothed. In addition, pitch discontinuity costing and smoothing is not applied across pauses in the speech longer than some threshold duration; these are assumed to be intonational phrase boundaries at which pitch resets are allowed.

Discontinuity smoothing operates as follows: The discontinuities at each segment boundary in the synthetic sentence are computed as described in the previous paragraph. A cumulative discontinuity curve is computed as the running total of these discontinuities from left to right across the sentence. This cumulative curve is then low pass filtered. The difference between the filtered and the unfiltered curves is then computed, and these differences used to modify the requested pitch values.

Smoothing may take place over an entire sentence or over regions delimited by periods of silence longer than a threshold duration. These are assumed to intonational phrase boundaries at which pitch resets are permitted.

The above modifications combined with the d.p. algorithm result in very high quality spliced or variable substituted speech in block 206.

To better understand why high quality spliced speech is provided by the present invention, consider the behavior of splice file speech with the d.p. cost function. As described above, splice file segments are not costed relative to predicted duration, energy or pitch values. Also, the pitch continuity, spectral continuity and energy continuity costs between segments adjacent in a splice file are by definition zero. Therefore, using a sequence of splice file segments which were originally adjacent has zero cost, except at the end points where the sequence must join something else. During synthesis, deep within regions in which the synthesis phone sequence matches a splice file phone sequence, large portions of splice file speech can be used without cost under the cost function.

At a point in the synthesis phone sequence which represents a boundary between the two splice file sequences from which the sequence is constructed, simply butting together the splice waveforms results in zero cost for duration, energy and pitch, right up to the join or boundary from both directions. However, the continuity costs at the join may be very high, since continuity between segments is not yet addressed. The d.p. automatically backs off from the join, and splices in segments from core inventory 28 (FIG. 1) to provide a smoother path between the two splice files. These core segments are costed relative to predicted duration and energy, and are therefore costed in more ways than the splice file segments, but since the core segments provide a smoother spectral and prosodic path, the total cost may be advantageously lower, therefore, providing an overall improvement in quality in accordance with the present invention.

Pitch discontinuity costing is applied to discourage the use of segments with widely differing pitches next to each other in synthesis. In addition, after segment selection, the pitch contour implied by the selected segment pitches undergoes discontinuity smoothing in an attempt to remove any serious discontinuities which may occur. Since there is no pitch discontinuity between segments which were adjacent in a splice file, deep within splice file regions there is no smoothing effect and the pitch contour is unaltered. Obtaining the pitch contour through synthetic regions in this way, works surprisingly well. It is possible to generate pitch contours for whole sentences in TTS mode using this method, again with surprisingly good results.

The result of the present invention being applied to generate synthetic speech is that deep within splice file regions, far from the boundaries, the synthetic speech is reproduced almost exactly as it was in the original recording. At boundary regions between splice files, segments from core inventory 28 (FIG. 1) are blended with the splice files on either side to provide a join which is spectrally and prosodically smooth. Words whose phone sequence was obtained from pronunciation dictionary 18, for which splice files do not exist, are synthesized purely from segments from core inventory 28, with the algorithms described above enforcing spectral and prosodic smoothness with the surrounding splice file speech.

Figure 5:
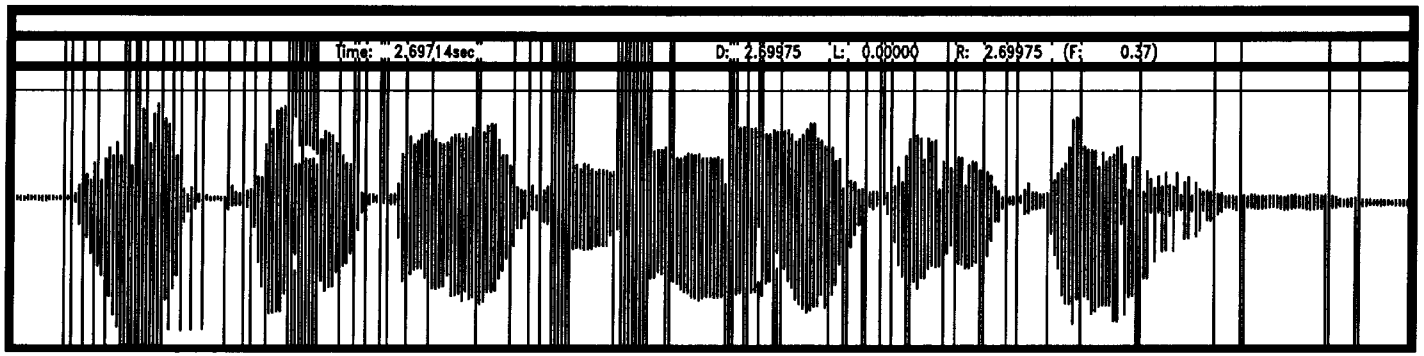
FIG. 5 is a synthetic speech waveform of a spliced sentence produced in accordance with the present invention.
Figure 6:
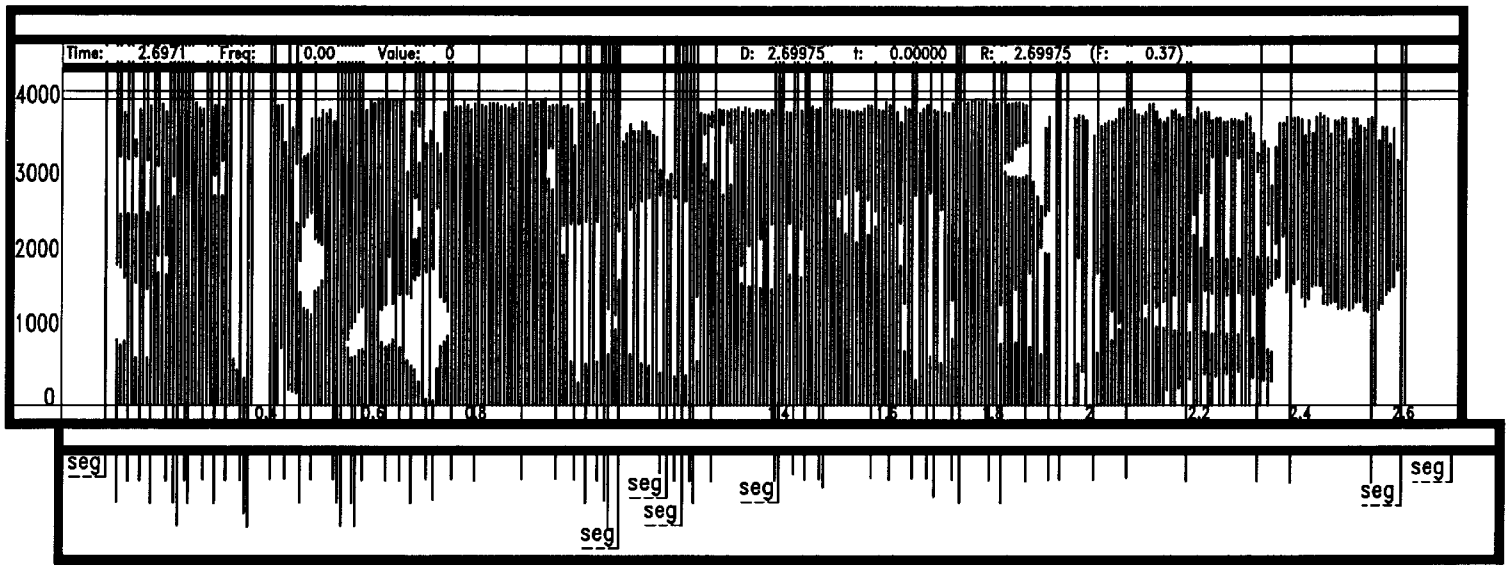
FIG. 6 is a wideband spectrogram of the spliced sentence of FIG. 5 produced in accordance with the present invention.

Referring now to FIGS. 5 and 6, a synthetic speech waveform (FIG. 5) and a wideband spectrogram (FIG. 6) of the spliced sentence "You have twenty thousand dollars in cash" is shown. Vertical lines show the underlying decision tree leaf structure, and "seg" labels show the boundaries of fragments composed of consecutive speech segments (in the training data or splice files) used to synthesize the sentence. The sentence was constructed by splicing together the two sentences "You have twenty thousand one hundred dollars." and "You have ten dollars in cash.". As can be seen from the locations of the "seg" labels, the pieces "You have twenty thousan-" and "-ollars in cash" have been synthesized using large fragments of splice files. The missing "-nd do-" region is constructed from three fragments from core inventory 28 (FIG. 1). Segments from other regions of the splice files may be used to fill this boundary as well. When performing variable substitution the method is substantially the same, except that the region constructed from core inventory 28 (FIG. 1) may be one or more words long.

The speech produced in accordance with the present invention can be heard to be of extremely high quality. The use of large fragments from appropriate prosodic contexts means that the sentence prosody is extremely good and superior to TTS synthesis. The use of large fragments, advantageously, reduces the number of joins in the sentence, thereby minimizing distortion due to concatenation discontinuities.

The use of the dynamic programming algorithm in accordance with the present invention enables the seamless splicing of pre-recorded speech both with other pre-recorded speech and with synthetic speech, to give very high quality output speech. The use of the splice file dictionary and related search algorithm enables, a host system or other input device to request and obtain very high quality synthetic sentences constructed from the appropriate pre-recorded phrases where possible, and synthetic speech where not.

The present invention finds utility in many applications. For example, one application may include an interactive telephone system where responses from the system are synthesized in accordance with the present invention.

Having described preferred embodiments of a system and method for phrase splicing and variable substitution using a trainable speech synthesizer(which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A method for providing generation of speech comprising the steps of:

providing splice phrases including recorded human speech to be employed in synthesizing speech;

constructing a splice file dictionary including every word and every word sequence for the splice phrases and including a phone sequence associated with every word and every word sequence for the splice phrases;

providing input to be acoustically produced;

comparing the input to training data in the splice file dictionary to identify one of words and word sequences corresponding to the input for constructing a phone sequence;

comparing the input to a pronunciation dictionary when the input is not found in the training data of the splice file dictionary;

identifying a segment sequence using a first search algorithm to construct output speech according to the phone sequence; and concatenating segments of the segment sequence and modifying characteristics of the segments to be substantially equal to requested characteristics.

2. The method as recited in claim 1, wherein the characteristics include at least one of duration, energy and pitch.

3. The method as recited in claim 1, wherein the step of comparing the input to training data includes the step of searching the training data using a second search algorithm.

4. The method as recited in claim 3, wherein the second search algorithm includes a greedy algorithm.

5. The method as recited in claim 1, wherein the first search algorithm includes a dynamic programming algorithm.

6. The method as recited in claim 1, further comprising the step of outputting synthetic speech.

7. The method as recited in claim 1, further comprising the step of using the first search algorithm, performing a search over the segments in decision tree leaves.

8. A method for providing generation of speech comprising the steps of:

providing splice phrases including recorded human speech to be employed in synthesizing speech;

constructing a splice file dictionary including every word and every word sequence for the splice phrases and including a phone sequence associated with every word and every word sequence for the splice phrases:

providing input to be acoustically produced;

comparing the input to application specific splice files in the splice file dictionary to identify one of words and word sequences corresponding to the input for constructing a phone sequence;

augmenting a generic segment inventory by adding segments corresponding to the identified words and word sequences;

identifying a segment sequence, using a first search algorithm and the augmented generic segment inventory to construct output speech according to the phone sequence; and concatenating the segments of the segment sequence and modifying characteristics of the segments of the segment sequence to be substantially equal to requested characteristics.

9. The method as recited in claim 8, wherein the characteristics include at least one of duration, energy and pitch.

10. The method as recited in claim 8, wherein the step of comparing includes the step of searching the application specific splice files using a second search algorithm and the splice file dictionary.

11. The method as recited in claim 10, wherein the second search algorithm includes a greedy algorithm.

12. The method as recited in claim 8, wherein the step of comparing includes the step of comparing the input to a pronunciation dictionary when the input is not found in the splice files in the splice file dictionary.

13. The method as recited in claim 8, wherein the first search algorithm includes a dynamic programming algorithm.

14. The method as recited in claim 8, further comprising the step of using the first search algorithm, performing a search over the segments in decision tree leaves.

15. The method as recited in claim 8, further comprising the step of outputting synthetic speech.

16. The method as recited in claim 8, wherein the step of identifying includes the step of bypassing costing of the characteristics of the segments from a splicing inventory against the requested characteristics.

17. The method as recited in claim 8, wherein the step of identifying includes the step of applying pitch discontinuity costing across the segment sequence.

18. The method as recited in claim 8, further comprising the step of selecting segments from a splicing inventory to provide the requested characteristics.

19. The method as recited in claim 8, wherein the requested characteristics include pitch and further comprising the step of selecting segments from the generic segment inventory to provide the requested pitch characteristics.

20. The method as recited in claim 19, further comprising the step of applying pitch discontinuity smoothing to the requested pitch characteristics provided by the selected segments from the generic segment inventory.

21. A system for generating synthetic speech comprising:

a splice file dictionary including splice phrases of recorded human speech to be employed in synthesizing speech the splice file dictionary including every word and every word sequence for the splice phrases and including a phone sequence associated with every word and every word sequence for the splice phrases;

means for providing input to be acoustically produced;

means for comparing the input to application specific splice files in the splice file dictionary to identify one of words and word sequences corresponding to the input for constructing a phone sequence;

means for augmenting a generic segment inventory by adding segments corresponding to sentences including the identified words and word sequences;

a synthesizer for utilizing a first search algorithm and the augmented generic inventory to identify a segment sequence to construct output speech according to the phone sequence; and means for concatenating segments of the segment sequence and modifying characteristics of the segments of the segment sequence to be substantially equal to requested characteristics.

22. The system as recited in claim 21, wherein the generic segment inventory includes pre-recorded speaker data to train a set of decision-tree state-clustered hidden Markov models.

23. The system as recited in claim 21, wherein the first search algorithm includes a dynamic programming algorithm.

24. The system as recited in claim 21, wherein the means for comparing includes a second search algorithm.

25. The system as recited in claim 24, wherein the second search algorithm includes a greedy algorithm.

26. The system as recited in claim 21, wherein the means for comparing compares the input to a pronunciation dictionary when the input is not found in the splice files.

27. The system as recited in claim 21, wherein the first search algorithm performs a search over the segments in decision tree leaves.

* * * * *